United States Patent [19]

Gazzarini

[11] Patent Number: 4,881,477

[45] Date of Patent: Nov. 21, 1989

[54] METHOD AND APPARATUS FOR THE AUTOMATIC TRANSFER OF PANTYHOSE AND SIMILAR ARTICLES FROM A TOE SEWING MACHINE TO A DRAWING MACHINE

[75] Inventor: Vinico Gazzarini, Impruneta, Italy

[73] Assignee: Solis S.r.l., Firenze, Italy

[21] Appl. No.: 219,285

[22] Filed: Jul. 14, 1988

[30] Foreign Application Priority Data

Jul. 14, 1987 [IT] Italy ..... 9434 A/87

[51] Int. Cl.[4] ..... D05B 21/00

[52] U.S. Cl. ..... 112/121.15; 223/43; 223/112

[58] Field of Search ..... 112/121.15, 121.11, 112/121.12, 121.29, 104; 223/43, 112

[56] References Cited

U.S. PATENT DOCUMENTS

| | | | |
|---|---|---|---|
| 4,516,513 | 5/1985 | Gazzarini | 112/121.15 |
| 4,519,327 | 5/1985 | Selvi | 112/121.15 |
| 4,549,493 | 10/1985 | Gazzarini | 112/121.15 |
| 4,566,615 | 1/1986 | Nakahira | 112/121.15 X |
| 4,598,656 | 7/1986 | Calamani et al. | 112/121.15 X |
| 4,602,710 | 7/1986 | Bell, Jr. et al. | 112/121.15 X |
| 4,608,936 | 9/1986 | Ball et al. | 112/104 |
| 4,620,494 | 11/1986 | Takatori et al. | 112/121.15 |
| 4,622,909 | 11/1986 | Gazzarini | 112/121.15 |
| 4,628,844 | 12/1986 | Hodges | 223/43 |
| 4,649,838 | 3/1987 | Gazzarini | 112/121.15 |

*Primary Examiner*—H. Hampton Hunter
*Attorney, Agent, or Firm*—McGlew and Tuttle

[57] ABSTRACT

A device for the automatic transfer of pantyhose and similar manufactured articles from a toe sewing machine, of a carrousel type with vertical axis, to a drawing machine of the type having a pair of vertical fixed shapes, includes a gripper for gripping the elastic edge of the articles in a loading station of a sewing machine, in order to transfer an elastic edge out of the sewing machine, overturning the edge, and for keeping the pantyhose in pendent and overturned attitude. The device includes a pusher for picking up the elastic edge of the pantyhose from the gripper while stretching it in the form of a rectangle and transferring the article in a pendant attitude to a predetermined position relative to the shapes of the drawing machine.

A transfer device for transferring the article onto the drawing machine effects the fitting of the legs of the pantyhose articles on the relevant shapes. In case of stopping of the toe sewing machine, the drawing machine is fed normally through the picker which is manually loaded with the articles, and in case of stopping of the drawing machine, the sewing machine can unload the articles into a provisional store.

The machine of the present invention is also suitable for transferring stockings and socks from the same toe sewing machine to the same drawing machine.

9 Claims, 8 Drawing Sheets

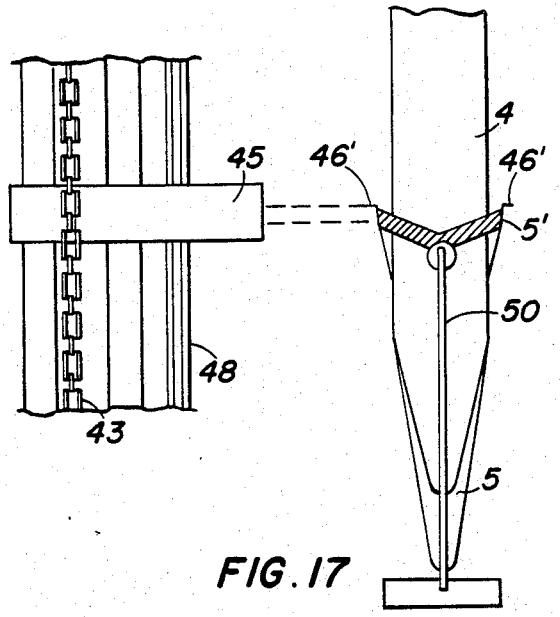
FIG. 17
FIG. 19
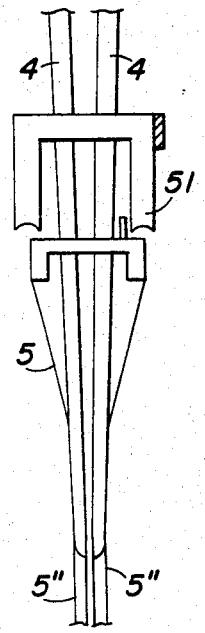
FIG. 20
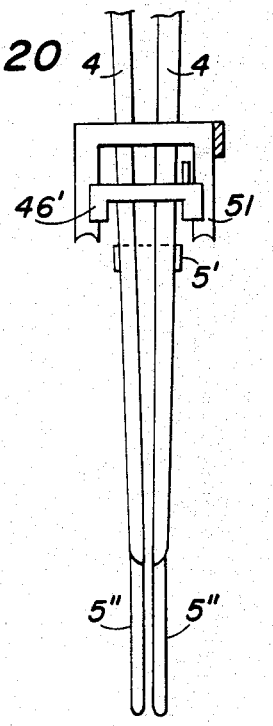

METHOD AND APPARATUS FOR THE AUTOMATIC TRANSFER OF PANTYHOSE AND SIMILAR ARTICLES FROM A TOE SEWING MACHINE TO A DRAWING MACHINE

FIELD AND BACKGROUND OF THE INVENTION

The invention relates in general to article transferring devices and in particular to a method and a machine for automatically transferring pantyhose, stocking and sock articles from a toe sewing machine to a drawing machine.

A device is known from the European patent No. 057.055 for the transfer of pantyhose articles from a horizontal-axis carrousel-type toe sewing machine supplied with pairs of horizontal tubes to a vertical-axis carrousel-type drawing machine supplied with pairs of horizontal dial-like arranged flat shapes which are provided of thermal resistors and are constructed in the form of two hinged elements to allow their book-like closing. The machines are mutually positioned so that the loading station of the drawing machine is opposite to the unloading station of the toe sewing machine, and a pair of shapes of one machine are coplanar and aligned with a pair of tubes of the other.

The very transfer device includes a carriage which is movable horizontally and alternately between stations of the two machines and is provided with hooks for the push-operated engagement of the elastic edge of the pantyhose to be transferred. The pantyhose bodice, during the travel of the carriage towards the drawing machine, is firstly overturned and then transferred to fit over the corresponding pair of shapes of the drawing machine. Such a transfer device has the drawback of imparting a slow work pace due to the idle stroke of the carriage conveyor and because it includes a rigid interaction system between the toe sewing machine and the drawing machine, so that the stopping of one of the machines brings about the inevitable stopping of the other, thereby drastically reducing the efficiency of the whole system.

SUMMARY OF THE INVENTION

The present invention is intended to overcome the drawbacks of the above device by realizing a machine which is able to transfer pantyhose, stocking and sock articles from a carousel-type, horizontal-axis toe sewing machine of the type having a pair of vertical fixed shapes, and make the operation of the machines independent of one another owing to the possibility of manually loading the transfer machine in case of stoppage of the toe sewing machine and, moreover, of unloading the pantyhose articles from the toe sewing machine onto a dwell-recovery store in case of stoppage of the drawing machine.

According to the present invention, an operative method takes into account that, what is referred to as pantyhose articles, is also valid for stockings and socks and implies, in succession, the following operations:

holding the pantyhose by its bodice elastic edge, transferring the article out of the toe sewing machine's station and overturning the elastic edge and the whole pantyhose article;

transferring the thus overturned pantyhose elastic edge onto a gripping device which moves with intermittence towards the drawing machine, stretching wide open the elastic edge in a vertical rectangle arrangement and subsequently disposing the thus stretched apart elastic edge on a horizontal plane and in a predetermined position in correspondence of the loading station of the drawing machine;

picking up the thus stretched apart and disposed pantyhose elastic edge and transferring the pantyhose downwards so as to fit the pantyhose legs over the two vertical fixed shapes of said drawing machine.

According to a preferred embodiment of the invention, a machine for the automatic transfer of pantyhose articles from a toe sewing machine to a pantyhose drawing machine, in compliance with the method provided by the invention, includes:

an arm with two grippers acting in correspondence of the two side ends of the elastic edge of the pantyhose bodice which is fitted on a pair of tubes of the toe sewing machine in its loading station, which arm is fixed to a carriage provided with a straight reciprocating motion in order to grip said elastic edge of the concerned pantyhose and take it outside of the machine, then overturning said elastic edge and holding the completely overturned pantyhose in a pendent attitude;

a horizontal intermittently rotating table having a plurality of operative stations, said table carrying as many horizontal arms with vertically stretchable apart elements each of which provides for taking the pantyhose elastic edge, kept stretched by said pair of grippers as above mentioned, out of the toe sewing machine, stretching it apart in a rectangle-like arrangement on a vertical plane while the pantyhose is in hanging attitude, rotating it afterwards about a horizontal axis and about a vertical axis in order to arrange the thus stretched apart pantyhose elastic edge in horizontal position and below said two vertical fixed shapes of the drawing machine, whose tips are turned downwards, and simultaneously disposing the pantyhose bodice seams in a vertical plane midway with respect to said shapes of the drawing machine, thereby predisposing the pantyhose legs for their fitting over said shapes;

two arms with two horizontal, parallel and horizontally stretchable apart prongs, associated with a carriage provided with vertical reciprocating motion, rearwardly positioned with respect to the drawing machine shapes, which prongs, upon the downwards travel, go inside the pantyhose elastic edge and pick it out from the corresponding arm of said rotary table and, upon the successive upwards travel, locate the pantyhose bodice around said shapes by fitting the pantyhose legs over them, means being provided for unloading the pantyhose from said prongs.

The solution proposed by the present invention allows the transfer of the pantyhose articles between two machines, one of them intended for sewing the toes and the other for drawing the articles while maintaining an independent operation to one another; and this thanks to the possibility of automatically unloading the articles from the toe sewing machine onto a parking store and of manually loading the articles onto an intermediate section of the present machine, all this with a very fast output pace (almost 2.5 seconds per pantyhose).

Accordingly it is an object of the invention to provide an improved device and method for the automatic transfer of pantyhose and similar articles from a toe sewing machine of a carousel type with a vertical axis to a drawing machine of a type having a pair of vertical mixing shapes.

A further object of the invention is to provide a device for transferring pantyhose and similar articles and to a method of carrying out the transfer which are simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

FIG. 17 shows the front view of the arm of FIG. 16;

FIG. 19 shows the front view of the arm of FIG. 18;

FIG. 20 shows the detail of the arm of FIG. 19 with the pantyhose being unloaded onto the shapes of the drawing machine.

GENERAL DESCRIPTION OF THE PREFERRED EMBODIMENT

Figure 1:
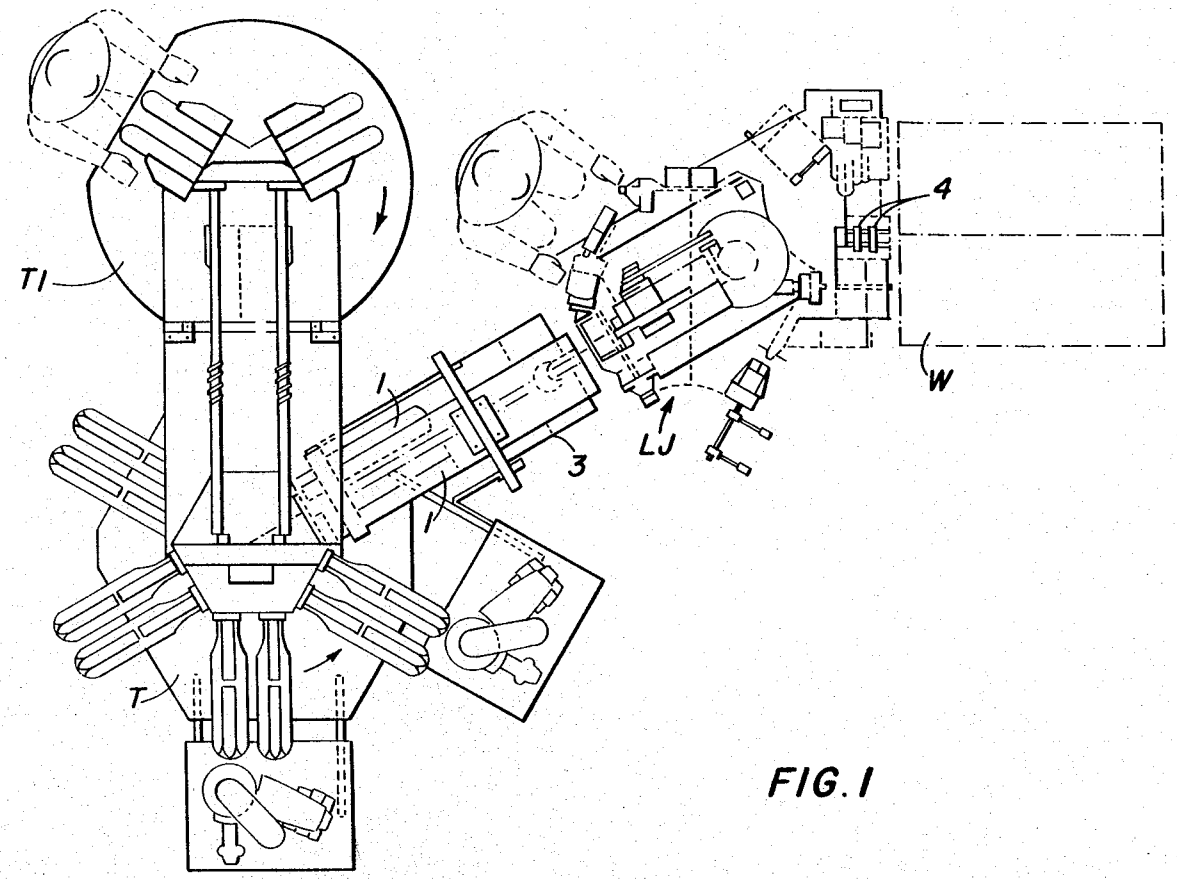
FIG. 1 is a general plan view of a machine for the transfer of pantyhose articles according to the invention, interposed between a toe sewing machine and a drawing machine.

Referring to the drawings in particular the invention embodied therein comprises a device and method for the automatic transfer of pantyhose and similar manufactured articles from a toe sewing machine to a drawing machine.

The method of automatically transferring the pantyhose articles, according to the invention, from a tow sewing machine of the so-called "SOLIS 4" type, for example, to a drawing machine of "Wepamat" type, for example, includes in succession the following operations:

gripping the side ends of the stretched elastic edge of the pantyhose from the toe sewing machine in correspondence of the unloading station thereof;

transferring, with horizontal motion, the pantyhose outside the toe sewing machine while keeping the pantyhose elastic edge oriented in a vertical plane;

overturning, that is turning said thus stretched elastic edge and the whole pantyhose right side out;

clamping the thus oriented elastic edge of the pantyhose which is made to hang down out of the toe sewing machine;

stretching apart said pantyhose elastic edge keeping it oriented in a vertical plane, while the pantyhose is in a pendent attitude during its intermittent transfer with curvilinear path towards the drawing machine;

rotating the so stretched apart pantyhose elastic edge through 90° about a horizontal axis in order to orient it in a horizontal plane to allow the access inside the pantyhose from above and predispose it for its fitting over the overhanging vertical shapes of the drawing machine;

rotating the so-oriented elastic edge about a vertical axis so as to predispose the pantyhose longitudinal seams, before fitting the pantyhose over the drawing machine shapes, in a vertical plane intermediate of said shapes;

lifting the thus oriented pantyhose elastic edge as far as to allow the fitting of the pantyhose legs over the shapes of the drawing machine.

In case of stopping of the toe sewing machine, there is provided for manually loading the pantyhose-transfer machine at a station on the running path towards the drawing machine.

In case of stopping of the drawing machine, it is provided for unloading the pantyhose articles on their exit from the toe sewing machine, across a parking store of so-called "Solpark" type, for example.

Figure 2:
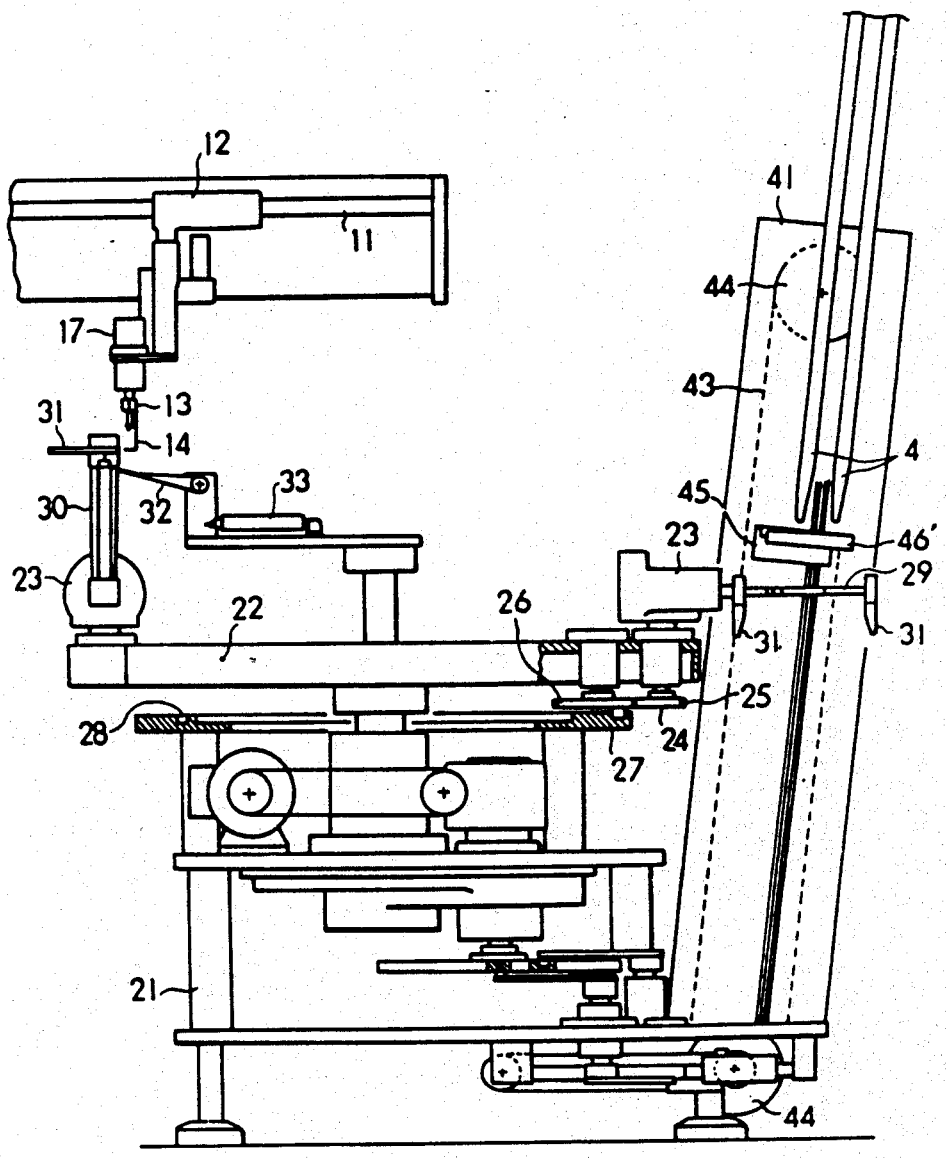
FIG. 2 shows a simplified side elevational view of the machine of FIG. 1.
Figure 3:
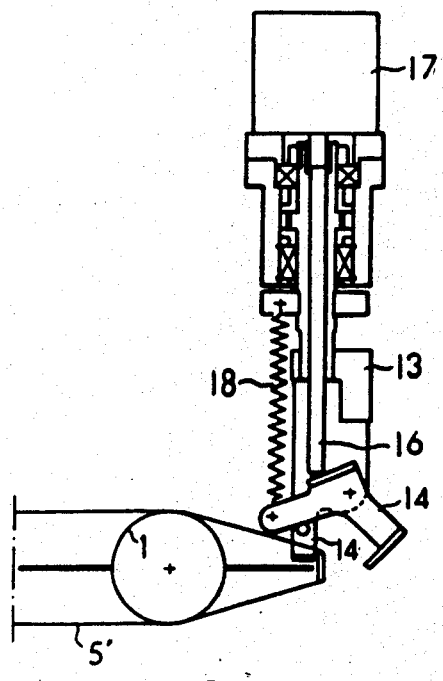
FIG. 3 is a front elevational view of a detail of a gripper for the clamping of the pantyhose in the loading station of the toe sewing machine, prior to the clamping phase.
Figure 4:
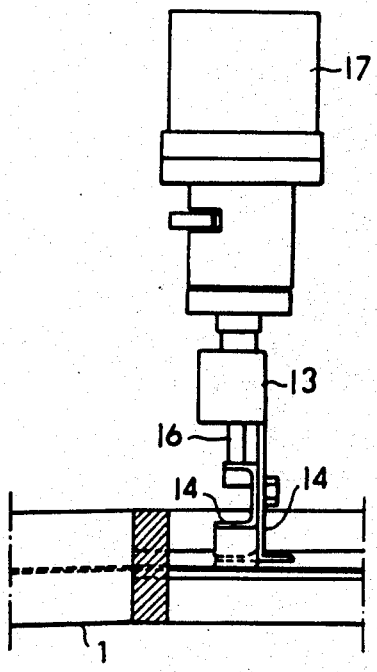
FIG. 4 shows a side view of the clamping gripper of FIG. 3.
Figure 5:
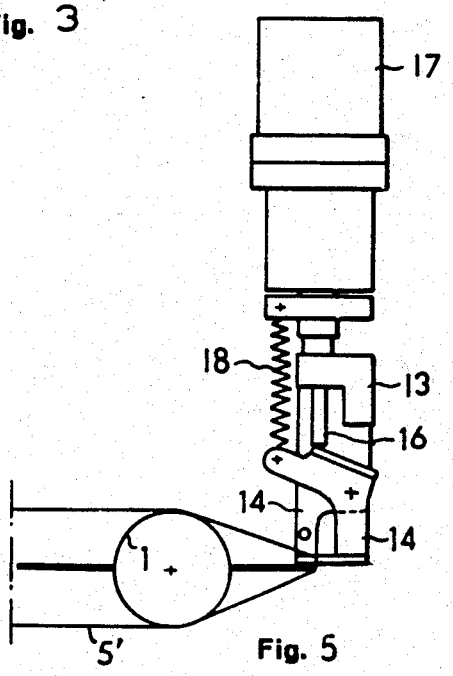
FIG. 5 shows the gripper of FIG. 3 after the clamping of the pantyhose elastic edge.
Figure 6:
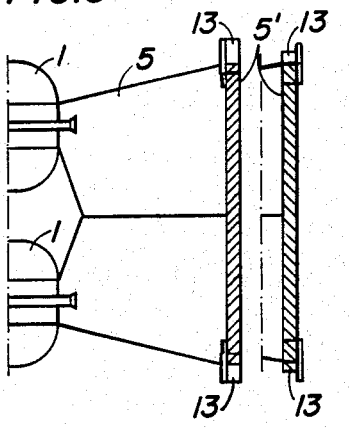
FIGS. 6 and 6*a* show the details of the pantyhose elastic edge respectively before and after its overturning operated by the pair of grippers according to claim 3.
Figure 6A:
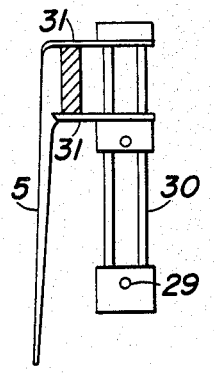
Figure 7:
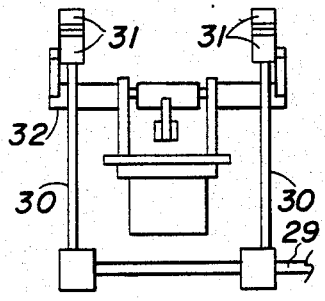
FIG. 7 shows, in front view, the details of an arm provided with stretchable apart elements of the transfer rotary table, in the first station (corresponding to the unloading station of the tow sewing machine), prior to the clamping of the pantyhose in the attitude of FIG. 6*a;*
Figure 11:
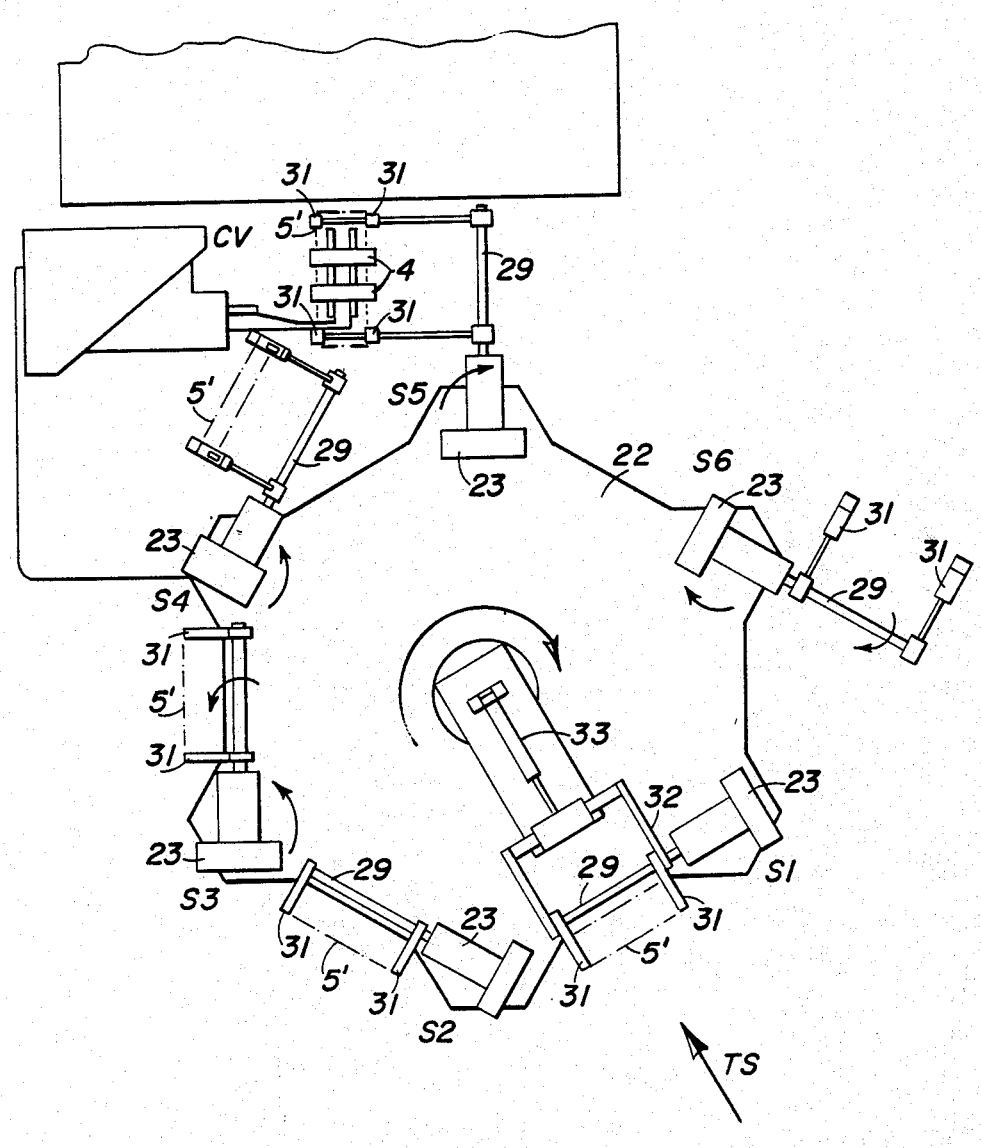
FIG. 11 shows the plan view of the table detail for the transfer of pantyhose articles from the toe sewing machine to the drawing machine.
Figure 12:
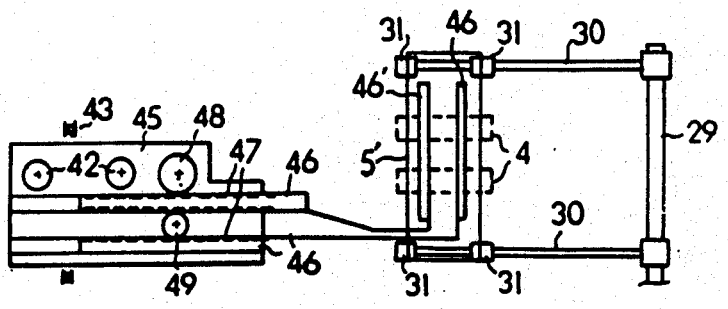
FIG. 12 shows the plan view of the arm detail with prongs for the fitting of the pantyhose over the shapes of the drawing machine before leaving the corresponding arm of the transfer table.
Figure 13:
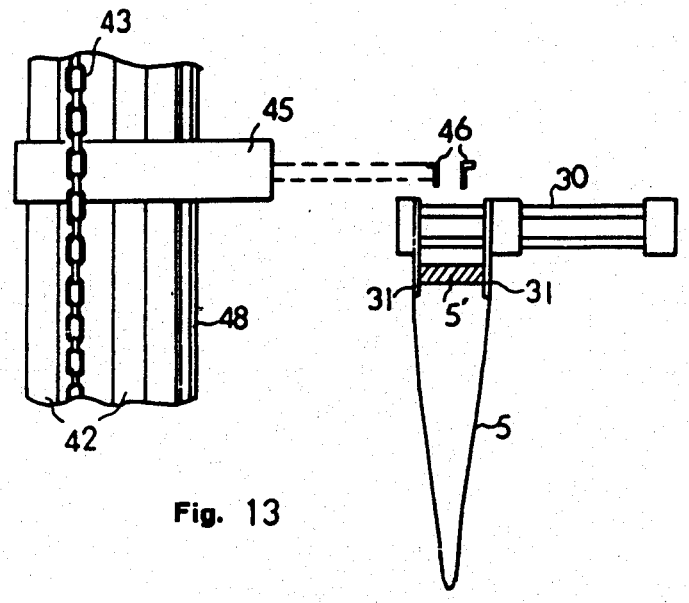
FIG. 13 shows the front view of the arm of FIG. 12.
Figure 14:
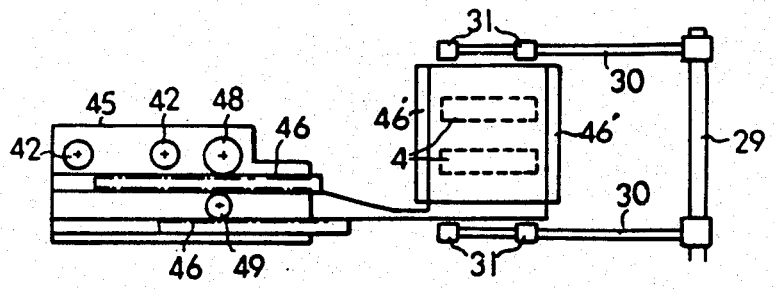
FIG. 14 shows the plan view of the arm of FIG. 12 after the pantyhose has left the corresponding arm of the transfer table.
Figure 15:
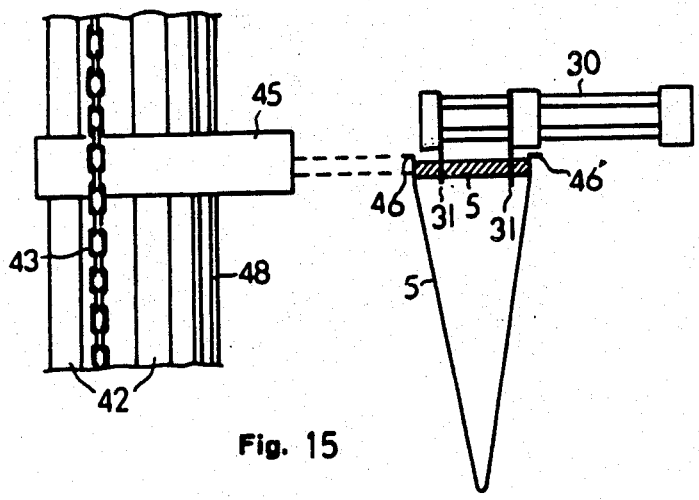
FIG. 15 shows the front view of the arm of FIG. 14.
Figure 16:
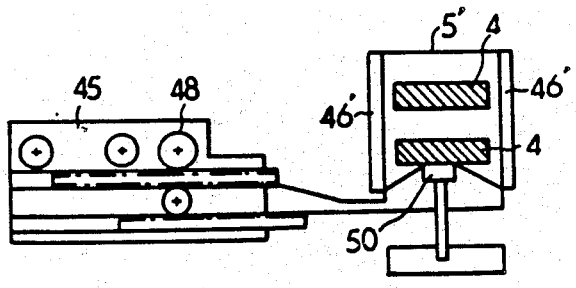
FIG. 16 shows the plan view of the arm of FIG. 14 approaching the end of the upwards stroke, with an extractor of oscillating type.
Figure 18:
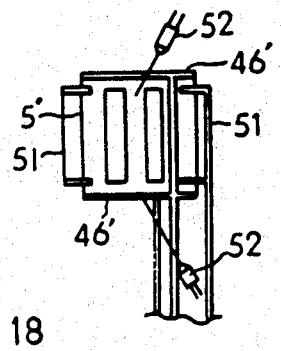
FIG. 18 shows the plan view in detail of the arm of FIG. 14 being close to the end of the upwards stroke, with an extractor of fixed type.

A machine for the transfer of pantyhose articles according to the above method and indicated by LJ in FIG. 1 of the attached drawings, is interposed between a toe sewing machine T of a so-called "SOLIS 4" type provided with a known device T1 for its automatic loading, and a drawing machine W of a type named "Wepamat", and is essentially made up of:

a first section (A) provided in correspondence of the unloading station TS of the toe sewing machine T (Ref. FIGS. 2 and 11), which comprises:

a horizontal track 11 located above and parallel to the two tubes 1 for the support and pneumatical overturning of the pantyhose articles of the tow sewing machine T, said track being longer than tubes 1 (FIGS. 3 to 5);

a carriage 12 alternatively movable on said track 11;

two grippers 13 supported on the carriage 12 and so disposed as to allow the gripping of the elastic edge 5' of pantyhose or similar articles 5 at points of maximum horizontal spacing apart, and whose tips 14—one being fixed and the other articulated—are both flat. The simultaneous opening of each gripper 13 is achieved by means of a rod 16 of a corresponding pneumatic cylinder 17 following its programmed activation. The simultaneous closing of each gripper is achieved by means of a corresponding return spring 18 following the deactivation of the relevant pneumatic cylinder 17. Each gripper 13 is also simultaneously interlocked to a rotary movement of 180° about its own vertical axis outwardly of the pantyhose articles, to allow the elastic edge 5' of pantyhose 5 to be overturned after the clamping thereof;

a second section (B), provided between the unloading station TS (FIG. 11) of the toe sewing machine T and the loading station CV of the drawing machine W (Ref. FIGS. 2 to 7–11), which comprises:

a bench 21 having a plurality of planes with an overhanging horizontal intermittently rotating table 22 with stops at a plurality of stations (six, for example) one of which being in correspondence of the unloading station TS of the toe sewing machine T and one being in correspondence of the loading station CW of the drawing machine W;

a plurality of supports 23 (six, for example) angularly mounted in equidistant relationship on the table 22 and driven into rotation through approximately 120° about the corresponding vertical axis, in order to allow their orientation with respect to the longitudinal axis radially of the table, according to the position to be taken up at the various table stations: to this end, the vertical shaft 24 of each support 23 is provided in its lower part with a gear 25 meshing with a corresponding gear 26 which is provided with a roller 27 housed in an annular groove 28 of the bench 21 and whose curvilinear profile is off-center with respect to the axis of table 22.

Figure 8:
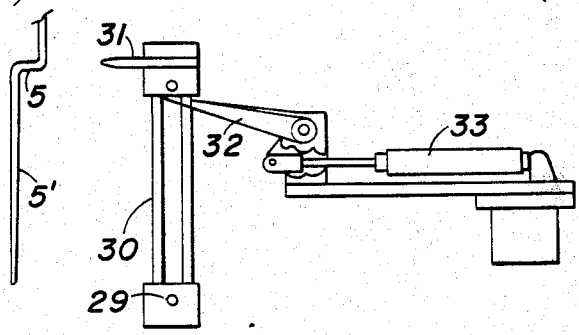
FIG. 8 shows a side view of the detail of FIG. 7.
Figure 9:
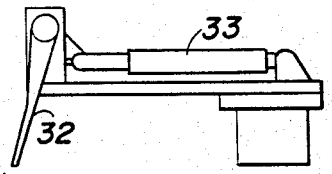
FIG. 9 shows the detail of FIG. 7 after the clamping of the pantyhose in the attitude of FIG. 6*a;*
Figure 10:
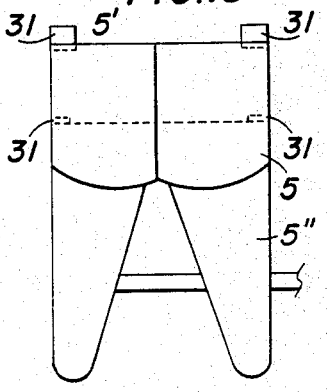
FIG. 10 shows the front view of the detail of FIG. 9.

Associated with each of said supports 23 is a horizontal arm 29 (FIG. 8) provided with two posts 30 the free ends of which carry two opposite beaks 31, one being fixed and the other movable on the corresponding post 30 and which are intended to pick up the pantyhose from said grippers 13 by a simultaneous stretching apart of its elastic edge 5', to form a rectangle. The arm 29 is also driven into an alternate rotation of 90° on its own axis to allow the orientation of the posts 30 either vertically or horizontally.

A linkage 32 is interlocked to a program actuated pneumatic cylinder 33, overhanging said table 22 and fixed to said bench 21 to operate the closing of beaks 31 of arm 29 which is in correspondence of the unloading station TS of the toe sewing machine T; the opening of said beaks being achieved by its own weight or by means of traditional return spring.

Following the activation of the pneumatic cylinder 33, a third section (C) is in correspondence of the loading station CV of the drawing machine W (Ref. FIGS. 2 and 11–20) and it comprises:

a vertical fixed structure 41 backwardly located with respect to shapes 4 of drawing machine W, with a track 42 and a chain 43 ring closed over two gears 44 the lower of which takes up the motion, through traditional means, from the same electrical motor which drives into rotation the table 22 of the second station B or from an independent electrical motor.

The third section also includes a carriage 45, sliding on said track 42 by means of said chain 43 and provided with two parallel arms 46 whose angle bent and facing ends 46' can be horizontally stretched apart. To this purpose, the arms 46 are provided with a corresponding toothing 47 with which a corresponding toothed vertical rod 48 going through said carriage 45 is made to engage. Its rotation is programmed in one direction or the other and causes the ends 46', in cooperation with an idle gear 49 interposed between the arms 46, to move close to or away from one another.

An extractor, such as an oscillating buffer 50, is located laterally of at least one of the shapes 4 of the drawing machine W, and it has a programmed intervention which allows the pantyhose 5 to be unloaded from said arms 46; alternatively, the extractor may be of a fixed type having two ledges 51 with two corresponding nozzles 52 blowing air on the pantyhose 5 in proximity of said arms.

The operation is as follows.

As soon as the toe sewing machine T carries a finished pantyhose, that is an article with sewed toes, into the unloading station TS (FIG. 11), the two grippers 13 of the first station (A) take the elastic edge 5' of pantyhose 5 which is stretched around the overturning tubes 1 (FIGS. 3 to 5) of the toe sewing machine T at the points of maximum horizontal distance, after which the carriage 12 moves to and beyond the end of tubes 1 and, while the suction of pantyhose legs 5'' inside the tubes causes their overturning, that is, the turning right side out thereof, the grippers 13, by rotating through 180° towards the outside of the pantyhose, provide for overturning of the elastic edge 5' thereof. When the carriage 12 reaches the end of stroke for its exit from the toe sewing machine T, the two pairs of horizontal beaks 31 of arm 29 of table 22 (arms 29 being at a standstill at the first station S1 of the second section (B)) find themselves inside the pantyhose elastic edge being clamped by the grippers 3, while the rest of the pantyhose is in a hanging attitude. Afterwards, as the carriage 12 goes back to the center of the tow sewing machine T, the clockwise rotation of the table 22 causes arm 29 to be carried therealong together with the pantyhose up to the second station S2 and, after a dwell, to the third station S3; between the third station S3 and the fifth station S5 of table 22, the arm 29 is made to rotate on its own axis through 90° downwardly outside of the table, and the support 23 is made to rotate anticlockwise on its own axis through approximately 120° so that, in the fifth station S5 of the table, the rectangle-like stretched pantyhose edge will be horizontal and located below the tips of shapes 4 of the drawing machine W and with the opening turned upwards, while the bodice seams of the pendant pantyhose will lie in a vertical plane midway of said shapes 4.

At this point, the carriage 45 of machine's third section C, which is at a higher level than the pantyhose's stretched edge and at a lower level than tips of shapes 4 of drawing machine W, is made to lower down and, as soon as the ends 46'' are within the elastic edge 5' of pantyhose 5, they are pulled wide apart thereby stretching the pantyhose elastic edge. While the carriage continues its downward travel, the edge is withdrawn from the beaks 31 of arm 29 of the second section B. Afterwards the carriage 45 goes up again until the legs 5'' of pantyhose 5 are fitted over shapes 4. The upward stroke limit of the pantyhose, with the consequent release of ends 46', is determined by the actuation of the extractor. If this is like the buffer 50, otherwise by the end of the pantyhose elastic edge 5' abutting against the above-standing fixed extractors 51.

Between the fifth and the first station of table 22, the arm 29 is made to rotate on its own axis through 90° upwards and the support is made to rotate around its own axis anticlockwise, so that once the support 23 is brought back to said first station S1 of table 22, the arm 29 and the corresponding beaks 31 will be at the same starting position.

When the machine operates at its normal condition, upon each dwell of table 22 a pantyhose is transferred from the toe sewing machine T to a corresponding arm 29 of table 22 while, at the same time, another pantyhose is transferred from a further table arm 29 to the ends 46' of arms 46 of carriage 45. The carriage is now in alignment with the drawing machine.

In case the toe sewing machine T comes to a standstill, the arms 29 of table 22 may be loaded manually in the second station S2 of the table, while in case the drawing machine W comes to a standstill, the pantyhose articles may be unloaded from the toe sewing machine T onto an underlying store 3.

Finally, owing to the fact that both the toe sewing machine T and the drawing machine W may also work stockings and socks, the machine according to the present invention is apt to transfer these articles as well from the first to the second machine.

In practice, the constructional details may vary in equivalent manner as far as the form, dimensions, element dispositions, nature of used materials are concerned without nevertheless departing from the scope of the solution idea being adopted and remaining therefore within the limits of the protection granted to the present patent for industrial invention.

While a specific embodiment of the invention has been shown and described in detail to illustrate the application of the principals of the invention, it will be understood that the invention may be embodied otherwise without departing from such principals.

What is claimed is:

1. A machine for the automatic transfer of pantyhose of similar articles from a toe sewing machine (T) having a standing surface to a drawing machine comprising:

a first section (A) in correspondence to an unloading station (TS) of a toe sewing machine (T) and comprising a sewing machine having a plurality of overturning tubes comprising a driven carriage arrangement, a horizontal track located above said tubes, means connected to said carriage for driving it in a straight reciprocating motion on said horizontal track above said overturning tubes (1) of the toe sewing machine (T), an arm on the toe sewing machine with two grippers (13) on said arm for clamping the elastic edge (5') of the pantyhose (5) supported by said tubes (1) at points of maximum horizontal spacing in order to carry said elastic edge (5') outside of the toe sewing machine (T) and overturn means for applying a pneumatic suction on the pantyhose legs (5'') within said overturning tubes and allowing the whole pantyhose to be overturned; a second section interposed between the unloading station of the toe sewing machine (T) and the loading station (CV) of the drawing machine (W) and comprising:

a bench with a horizontal table intermittently rotating about its own vertical axis and performing a dwell at six operative stations, on which an equal number of supports are mounted each of which with a corresponding horizontal arm carrying two pairs of beaks which are vertically stretchable apart in order to seize the elastic edge on the pantyhose from said pair of grippers of said first section and to then stretch it open in the form of a rectangle while leaving the pantyhose hanging down, said arm and said support having rotation means so that said arm and said support are able to rotate about their own axis in order to first arrange said elastic edge of the thus stretched pantyhose in horizontal position and above tips of shapes (4) of the drawing machine (W), and with the longitudinal seams of pantyhose resulting in a vertical plane intermediate to said shapes and, subsequently, take up again the initial position of the table first station;

a third section in correspondence of a drawing machine and comprising:

a carriage driven by a vertical alternate motion and provided with two horizontal arms with right-angle bent and facing ends which allow, during the downwards travel of carriage, the introduction of said ends through the opening of the pantyhose and the withdrawal of the elastic edge (5') from the beaks of an arm of said second section and, during the successive upwards travel of the carriage, the fitting of the pantyhose legs over the shapes of the drawing machine.

2. A machine according to claim 1, characterized in that each gripper has two tips wherein one of the tips of each gripper is engaged with a rod of a corresponding pneumatic cylinder whose programmed activation causes the opening of the same gripper, the closing being obtained by a return spring after the deactivation of said pneumatic cylinder.

3. A machine according to claim 1, characterized in that said grippers are driven into a simultaneous rotation through 180° about its own vertical axis, outwardly of the pantyhose, to allow the overturning of the elastic edge (5') of the clamped pantyhose.

4. A machine according to claim 1, characterized in that on a vertical shaft of said supports (23) a gear (25) is mounted in the lower part thereof meshing with a corresponding gear (26) provided with a small roller (27) guided within an annular groove (28) of the bench (21) whose curvilinear profile is off-center of the axis of table (22) so as to allow the rotation of the relevant support (23) in one direction and respectively in the other, between the third and fifth station, and fifth and first stations, respectively, of said table (22).

5. A machine according to claim 1, characterized in that the closing of beaks (31) of the arm (29) corresponding to support (23) located in the first station (51) of table (22), is achieved by a leverage (82) engaged to a program-actuated pneumatic cylinder.

6. A machine according to claim 1, characterized in that the stretching apart of ends (46') of said arms (46) is accomplished by rotation, in one direction or the other, of a vertical toothed rod (48) engaging the toothing (47) of one of said arms (46), the other arm being engaged to the first one through an idle gear (49) interposed between said arms.

7. A machine according to claim 1, characterized in that the elastic edge (5') of pantyhose (5) is withdrawn from said arms (46), after the legs (5'') have been made to fit over the shapes (4) of the drawing machine (W), by means of at least a buffer (50) extractor which is brought to press on the pantyhose against one of said shapes (4).

8. A machine according to claim 1, characterized in that the pantyhose elastic edge (5') is withdrawn, after the legs (5'') are made to fit over the shapes (46) of the drawing machine (W), from the ends (46') of said arms (44) by means of two fixed extractors (51) intercepting the portions of said elastic edge which are released from the ends (46') of said arms (46).

9. A machine for the transfer of pantyhose or like garments from a toe sewing machine to a drawing machine comprising:

a track;

a carriage riding on said track;

a plurality of gripper means connected to said carriage, for grabbing an elastic edge of pantyhose from an unloading area of said toe sewing machine and for transferring the pantyhose outside the toe sewing machine with horizontal motion while keeping said elastic edge of said pantyhose in a vertical plane;

a bench with rotatable table means for stopping intermittently at a plurality of stations;

support means positioned at each station, said support means having a vertical axis for rotation of substantially 120° about said vertical axis, a horizontal arm on each support means connected to two spaced apart posts, one end of each post connected to the arm, the other end being free, said horizontal arm being rotatable on its axis;

beak means connected to each said free end, said beak means being synchronized with the sewing machine for picking up the pantyhose from said gripper means by stretching apart the elastic edge of said pantyhose to form a rectangle;

linkage means, connected to a program actuated pneumatic cylinder overhanging said table and fixed to said bench for operating closing of the beak means when in correspondence to the unloading station of the toe sewing machine;

said horizontal arm and said support means positioning said pantyhose edge in a horizontal position, as said pantyhose rotates towards the drawing machine;

the drawing machine having a corresponding fixed structure, a carriage means that rides vertically on said fixed structure, said carriage means provided with parallel horizontal arms and means to allow the parallel arms to move together and apart, said parallel arms being at a higher position than said pantyhose as said pantyhose comes into alignment to the drawing machine, said carriage means moving downward until said parallel arms are within said elastic edge of said pantyhose, said parallel arms then moving apart to spread apart said elastic edge and remove said edge from said beak means, said carriage means and said pantyhose subsequently moving upward to contact shapes of the drawing machine, extracting means releasing said parallel arms of said carriage from said pantyhose.

* * * * *